United States Patent [19]

Mima

[11] Patent Number: 4,494,368

[45] Date of Patent: Jan. 22, 1985

[54] METHOD OF PREVENTING IRREGULAR UNTWISTING OF YARN ENDS IN SPLICING SPUN YARNS

[75] Inventor: Hiroshi Mima, Kyoto, Japan

[73] Assignee: Murata Kikai Kabushiki Kaisha, Kyoto, Japan

[21] Appl. No.: 466,726

[22] Filed: Feb. 15, 1983

[30] Foreign Application Priority Data

Feb. 18, 1982 [JP] Japan ..... 57/24955

[51] Int. Cl.[3] ..... D01H 15/00

[52] U.S. Cl. ..... 57/22; 57/263

[58] Field of Search ..... 57/22, 261, 263

[56] References Cited

U.S. PATENT DOCUMENTS

| | | | |
|---|---|---|---|
| 4,246,744 | 1/1981 | Matsui et al. | 57/261 X |
| 4,322,943 | 4/1982 | Rohner et al. | 57/22 X |
| 4,356,688 | 11/1982 | Zurcher et al. | 57/22 |
| 4,408,442 | 10/1983 | Rohner | 57/261 X |

*Primary Examiner*—Donald Watkins

*Attorney, Agent, or Firm*—Spensley, Horn, Jubas & Lubitz

[57] ABSTRACT

A method for preventing the irregular untwisting of yarn ends in pneumatic yarn splicing apparatus. The respective free yarn ends to be spliced are untwisted and loosened in the control nozzles and each untwisted yarn ends is cut at a predetermined position thereof. The cut yarn ends are overlapped in a splicing hole and spliced by the jetted fluid stream.

10 Claims, 10 Drawing Figures

METHOD OF PREVENTING IRREGULAR UNTWISTING OF YARN ENDS IN SPLICING SPUN YARNS

BACKGROUND OF THE INVENTION

The present invention relates to an improved splicing method for spun yarns using a pneumatic yarn splicing apparatus.

According to a known spun yarn splicing method as shown in U.S. Pat. No. 4,263,775, the respective yarn ends of yarns to be spliced are pneumatically untwisted, overlapped one over the other and then, spliced pneumatically. In such a pneumatic yarn splicing method, yarn ends have always to be untwisted in the same condition. However, slubs and neps are contained in a spun yarn to be spliced and the fibers are not always in a uniform condition. When the end of a yarn containing such slubs and neps is untwisted pneumatically, fibers which have to be blown off by an air flow remain in the extremity of the yarn end and thereby faulty untwisting of the yarn end results. When such faulty untwisted yarn ends are spliced, the joint will be hairy with protrusion of fibers, which is not desirable.

SUMMARY OF THE INVENTION

The present invention relates to a method of preventing the irregular untwisting of yarn ends in splicing spun yarns.

An object of the present invention is to provide an improved spliced joint of spun yarns and is more particularly to prevent slubs and neps existing in the untwisted yarn ends impeding satisfactory untwisting of the yarn ends and forming hairy projections in the spliced part and to eliminate residual fibers which are to be removed from the yarn ends by means of a jet and yet remaining within the yarn end. The present invention is characterized in cutting the untwisted yarn ends of yarns at the respective predetermined positions to make the respective lengths of the yarn ends uniform prior to the splicing step and to remove the faulty untwisted yarn ends due to the slubs and neps.

DETAILED DESCRIPTION OF THE INVENTION

The present invention will be described hereinafter with reference to an embodiment for carrying out the method of the present invention.

Figure 1:
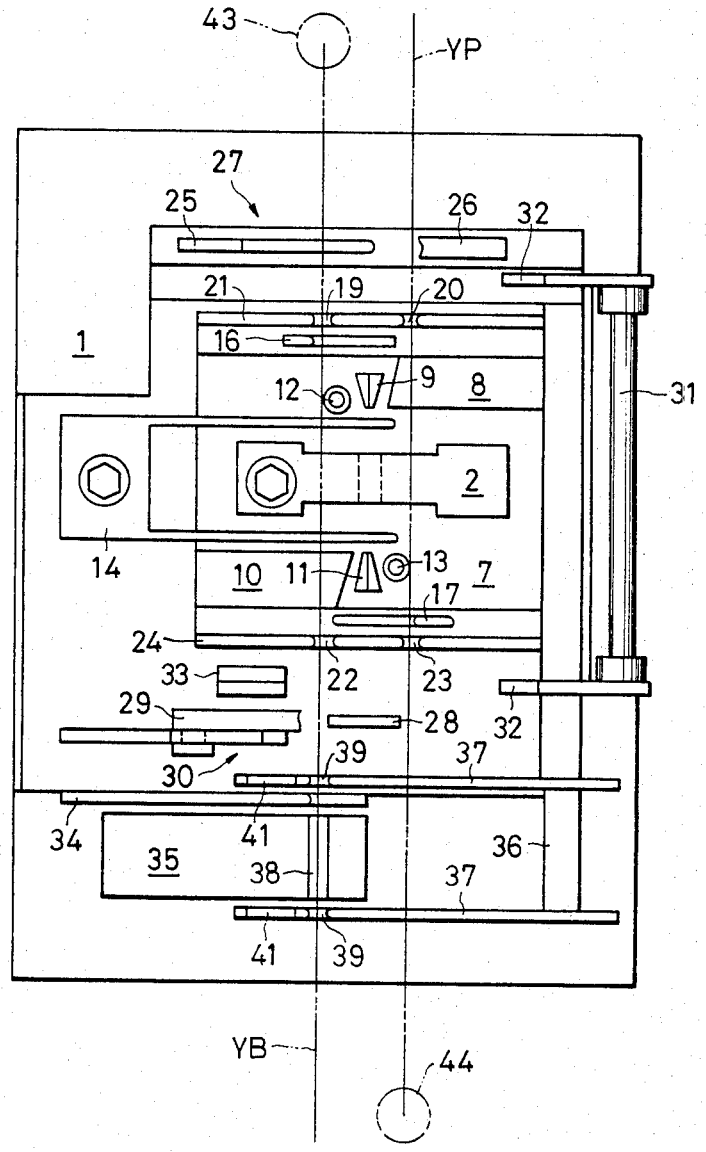
FIG. 1 is a front elevation of a yarn splicing device and a detecting device.

FIG. 1 is a front elevation of a pneumatic yarn splicing device 1 as applied to an automatic winder. A yarn splicing member 2 is disposed in the central part of the yarn splicing device 1. An open slit 3 and a splicing hole

Figure 5:
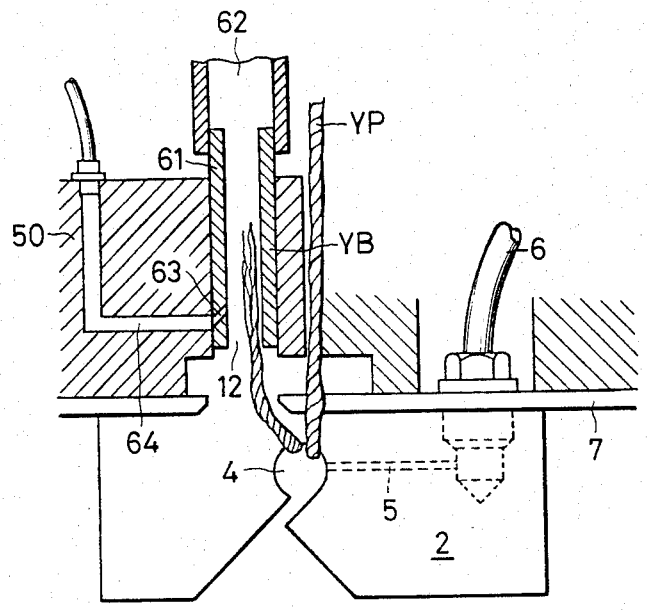
FIG. 5 is a sectional view of a part of the yarn splicing device illustrating a splicing member and control nozzles.

4 are formed successively in the front side of the splicing member 2 as shown in FIG. 5 and air is jetted from a jet nozzle 5 into the splicing hole 4 for yarn splicing. A conduit 6 is connected to a pressurized air source, not shown. The yarn splicing member 2 is fastened to a bracket 7 with a screw. The bracket 7 has yarn guides 8, 9, 10 and 11. Control nozzles 12 and 13 for untwisting yarn ends are opened on the bracket 7. The yarn splicing member 2 is inserted between a yarn pressing lever 14, which serves to put yarns into the yarn splicing hole 4. The yarn pressing lever 14 is turned by pulling a rod 15 attached to the base part of the yarn pressing lever 14. Each of yarn cutting devices 16 and 17 has a stationary blade and a movable blade and is operated by a lever 18 connected to the movable blade. A forked guide 21 having guide grooves 19 and 20 and a forked guide 24 having guide grooves 22 and 23 are disposed at the out sides of the cutting devices 16 and 17 respectively. A package side yarn end clamping device 27 comprising a turning lever 25 and a clamping plate 26 is disposed above the forked guide 21, while a bobbin side yarn end clamping device 30 comprising a lever 28 and a movable clamping plate 29 is disposed below the forked guide 24. A pair of yarn handling levers 32 supported pivotally on a shaft 31 are disposed at the right hand of the yarn splicing member 2. A stopper for stopping the yarn handling lever 32 is indicated at 33. A detecting device 35 attached to a stationary guide plate 34 is disposed under the bobbin side yarn end clamping device 30. The detecting device 35 inspects a yarn to be spliced and a yarn running therethrough during normal winding operation. A pair of changing levers 37 pivotally supported on a shaft 36 are disposed so as to put the stationary guide plate 34 and the detecting device 35 therebetween. A guide groove 39 which can be aligned with the yarn passage 38 of the detecting device 35, an escape groove 40 connecting with the guide groove 39 and a hook 41 are formed in each of the changing levers 37.

Figure 6:
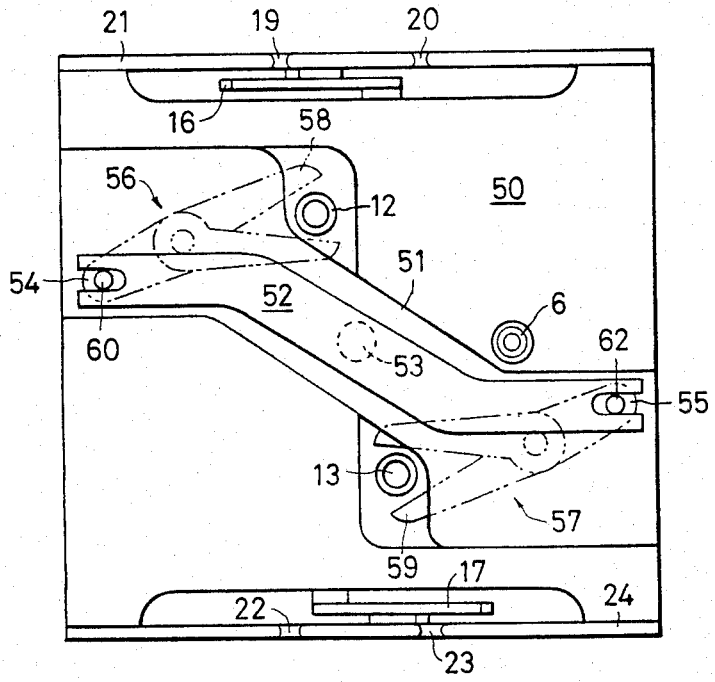
FIG. 6 is a front elevation of the yarn splicing device in which a bracket is removed.

In FIG. 6, the bracket 7 is removed from the device. A groove 51 is formed in the front side of a block 50. A cutter actuating lever 52 is disposed in the groove 51 and is pivoted on a shaft 53. Pins 60 and 62 secured to the movable blades 58 and 59 of irregular untwisting preventing yarn cutting devices 56 and 57 are inserted into bifurcate parts 54 and 55 formed in the opposite ends of the cutter actuating lever 52, respectively. The rotatory reciprocation of the cutter actuating lever 52 causes the respective movable blades 58 and 59 of the irregular untwisting preventing yarn cutting devices 56 and 57 to open or close for the cutting operation. The respective free ends of the movable blades 58 and 59 are disposed above the respective openings of the control nozzles 12 and 13, respectively.

Since the control nozzles 12 and 13 are identical in shape, only the control nozzle 12 will be described. Referring to FIG. 5, a nozzle hole of the control nozzle 12 is drilled in the block 50. A tubular nozzle pipe 61 is fitted axially slidably in the nozzle hole. The nozzle pipe 61 is connected to a flexible pipe 62 connected to a suction pipe, not shown. A jetting hole 63 directed inward of the nozzle pipe 61 is formed diagonally in the vicinity of the opening end of the nozzle pipe 61. The jetting hole 63 is connected to a pressurized conduit pipe, not shown, through a fluid supply passage 64 pierced through the block 50.

The yarn splicing method of the present invention will be described hereinafter.

Figure 3:
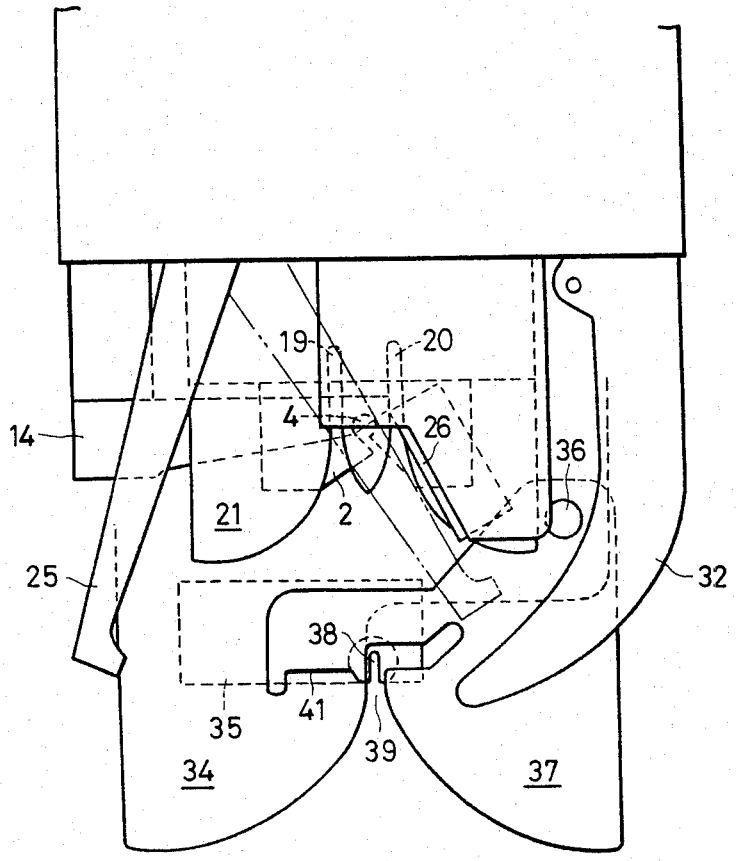
FIG. 3 is a plan view of the yarn splicing device of FIG. 1.
Figure 4:
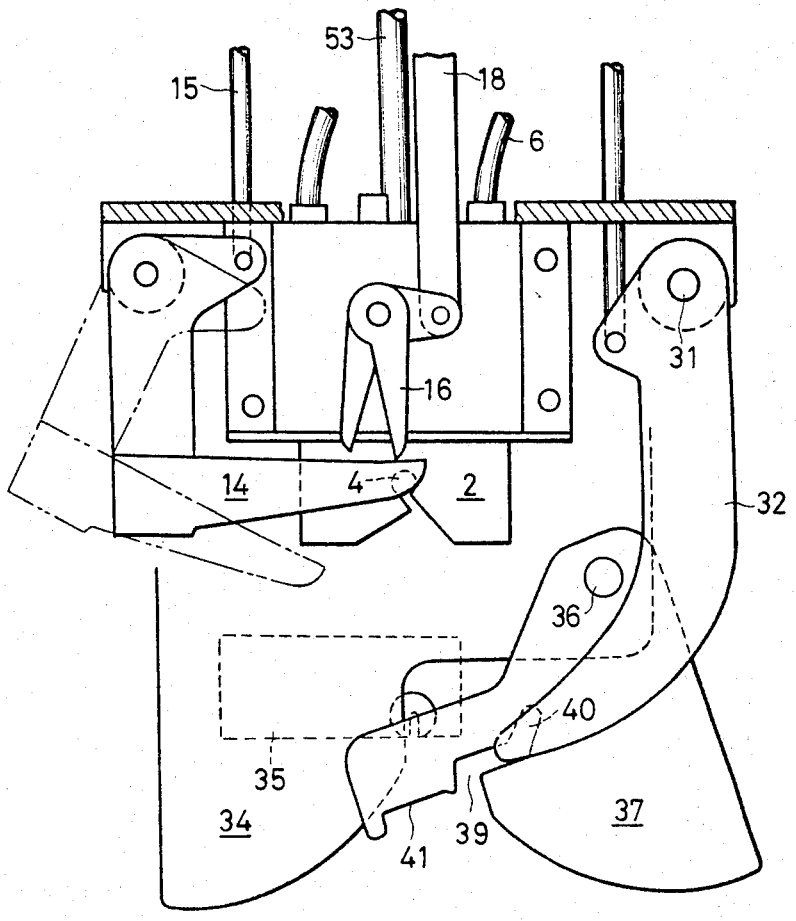
FIG. 4 is a plan view partly cut away of the yarn splicing device of FIG. 3.

When the detecting device 35 for detecting the yarn breakage or the exhaution of yarn layers formed on a bobbin detects the interruption of running of a yarn during winding operation, the winding operation is interrupted and yarn splicing operation is started. Paired package side and bobbin side suction arms 44 and 43 suck in a package side yarn end YP and a bobbin side yarn end BP, respectively, and turn to introduce the yarn ends to the yarn splicing device 1. The paired suction arms 44 and 43 turn individually; first the package side suction arm 44 sucks in the package side yarn end YP, turns toward the yarn splicing device 1 and stops at a position outside of the yarn splicing device 1, then, after a predetermined period of time, the bobbin side suction arm 43 sucks in the bobbin side yarn end YB, turns toward the yarn splicing device 1 and stops at a position outside of the yarn splicing device 1. Within an interval between the completion of operation of the package side suction arm 44 and the start of operation of the bobbin side suction arm 43, the turning lever 25 of the package side yarn clamping device 27 operates to place the yarn YP between the turning lever 25 and the clamping plate 26 and to bring the yarn YP to the stationary guide plate 34 disposed adjacently to the detecting device 35 and to the guide groove 39 of the changing lever 37, as shown in FIGS. 3 and 4. After the detecting device 35 has inspected the yarn YP, the changing lever 37 turns about a shaft 36 to a position illustrated by solid lines in FIG. 4 to remove the yarn YP from the detecting device 35 and to guide the yarn YP into the escape groove 40. Then, the bobbin side suction arm 43 sucks in the bobbin side yarn YB, turns toward the yarn splicing device 1 and stops at a position outside of the yarn splicing device 1. During such operation of the bobbin side suction arm 43, the yarn YB is guided to a position between the lever 28 of the bobbin side clamping device 30 and the clamping plate 29 via the hook 41 of the changing lever 37.

Figure 2:
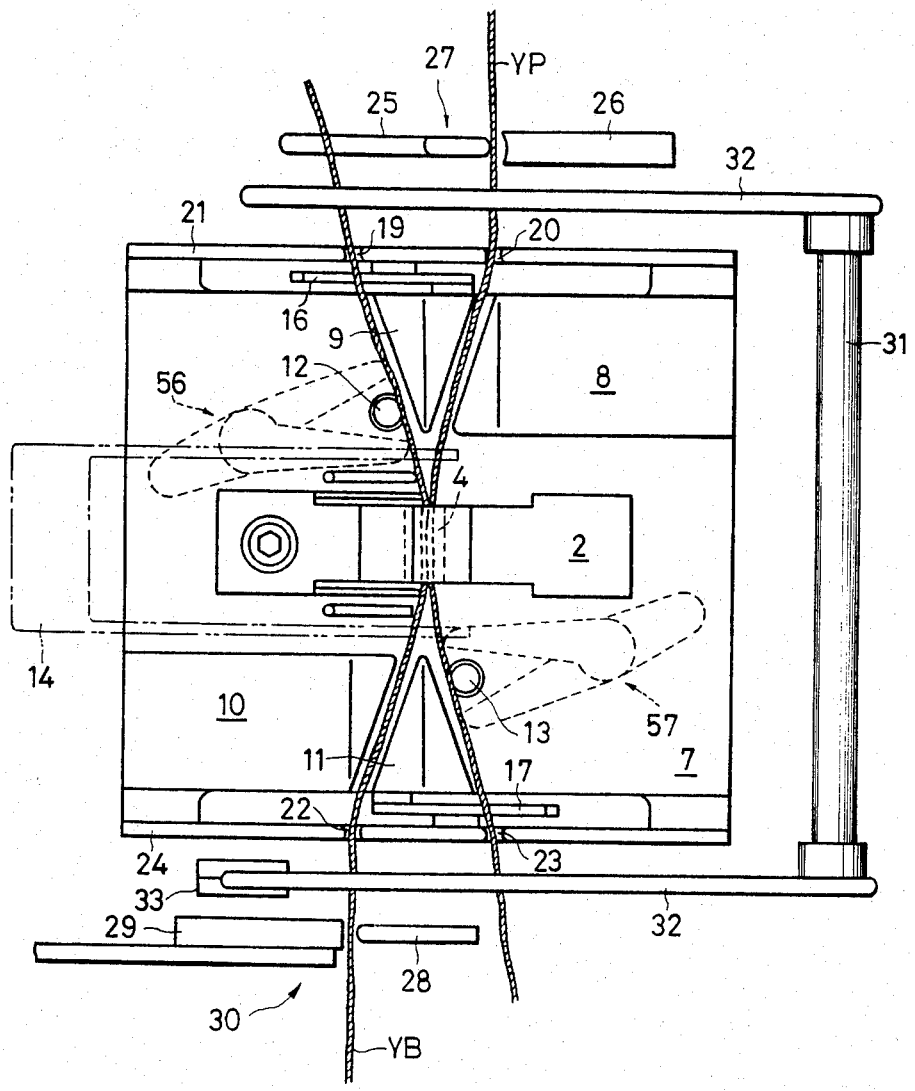
FIG. 2 is a front elevation of the yarn splicing device.
Figure 7:
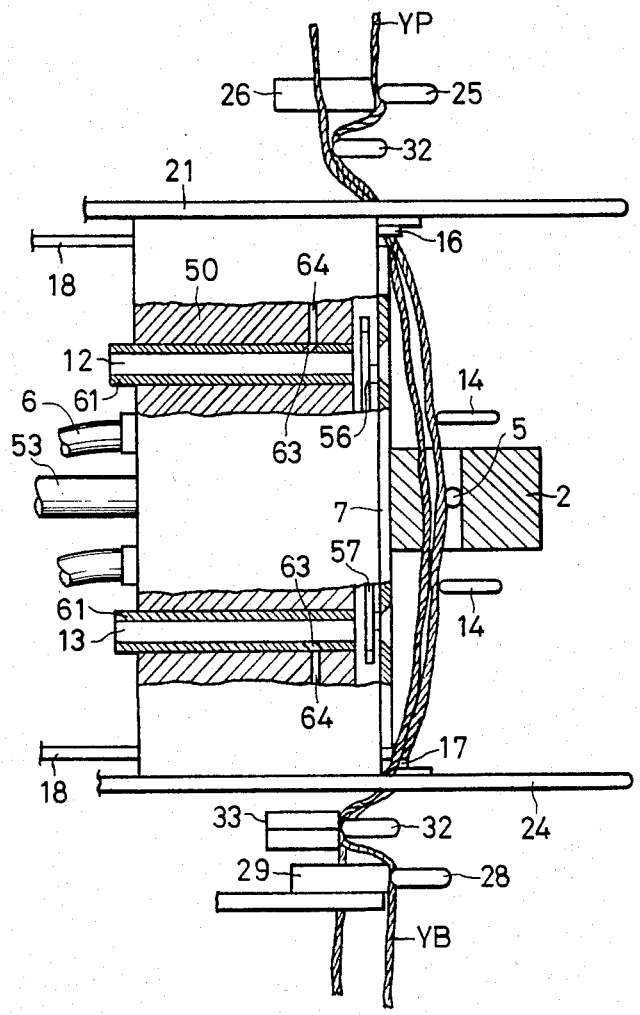
FIGS. 7 through 10 are side views partly in section illustrating control nozzles.

After the completion of the operation of the bobbin side suction arm 43 and the package side suction arm 44, the yarn collecting levers 32 turns on the shaft 31 to guide the bobbin side yarn YB into the guide groove 19 of the forked guide 21, the splicing hole 4 of the yarn splicing member 2, a groove formed between the yarn guides 10 and 11 and the guide groove 22 of the forked guide 24 and to guide the package side yarn YP into the guide groove 20 of the forked guide 21, a groove formed between the yarn guides 8 and 9, the splicing hole 4 of the yarn splicing member 2 and the guide groove 23 of the forked guide 24, as shown in FIG. 2. Then, the turning lever 25 of the package side clamping device 27 is pressed against the clamping plate 26 to clamp the package side yarn YP and the clamping plate 29 of the bobbin side clamping device 30 is pressed against the lever 28 to clamp the bobbin side yarn YB (FIG. 7).

After the yarns YP and YB have been clamped, the levers 18 of the yarn cutting devices 16 and 17 are pulled to actuate the yarn cutting devices 16 and 17 so as to cut the corresponding yarns at the respective predetermined positions with respect to the bobbin side clamping device 30 and the package side clamping device 27.

Figure 8:
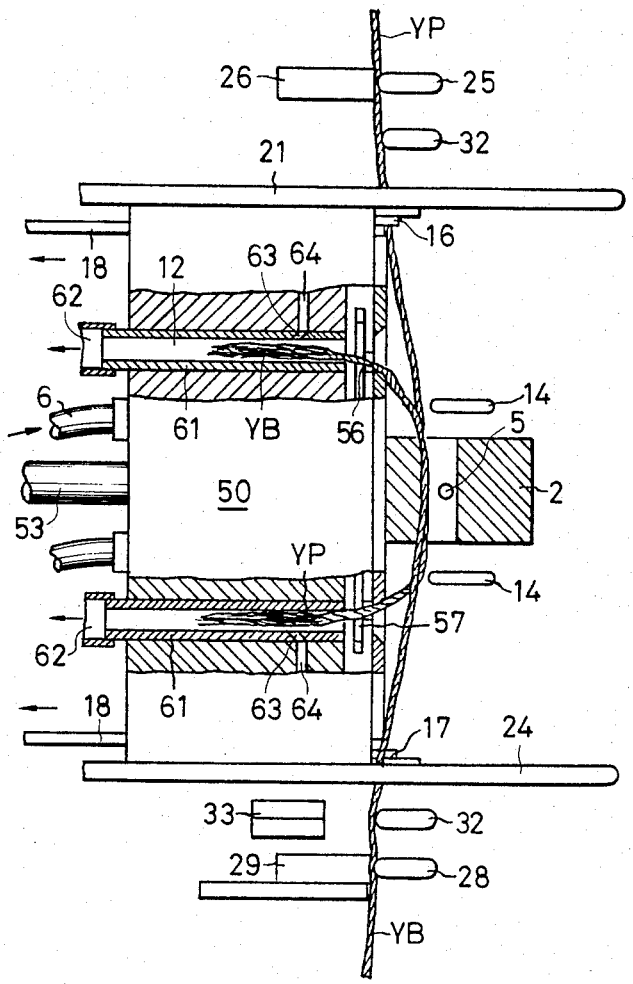

The control nozzles 12 and 13 are activated in synchronism with the yarn cutting operation to suck in the cut yarn ends into the control nozzles 12 and 13 as shown in FIG. 8. Then, the yarn handling levers 32 are retracted to allow the yarn ends to be sucked further into the control nozzles 12 and 13. The sucking action of the control nozzle 12 is caused by the suction effect of the flexible pipe 62 connected to the nozzle pipe 61. At the same time, a pressurized fluid is applied from the jetting hole 63 drilled in the nozzle pipe 61 into the nozzle pipe 61 through the fluid supply passage 64 formed in the block 50 to untwist and loosen the yarn end sucked in the nozzle pipe 61.

Since the nozzle pipe 61 is axially movable in the nozzle hole, the pressurized fluid applying position of the jetting hole 63 can be changed and hence the position where the pressurized fluid is applied to the yarn end come to be varied corresponding to the axial position of the nozzle pipe 61, so that the untwisted length of the yarn end and the degree of untwisting vary. When the nozzle pipe 61 is inserted less deep into the nozzle hole, the jetted fluid is applied to the yarn end at the relatively upper part away from the tip of the yarn, so that longer part of the yarn end is untwisted and the free end of the yarn end is tapered off in a hairy state. When thus untwisted yarn ends are spliced up, a bad joint is formed and neps are liable to be formed. On the other hand, when the nozzle pipe 61 is inserted too deep into the nozzle hole, the jetted fluid encounters the yarn end near the free end thereof, so that shorter part of the yarn end is untwisted and a weak joint or a thick joint is formed. Accordingly, the axial position of the nozzle pipe 61 is adjusted according to the type of yarn and yarn count to provide a satisfactory untwisted state of yarn ends.

Figure 9:
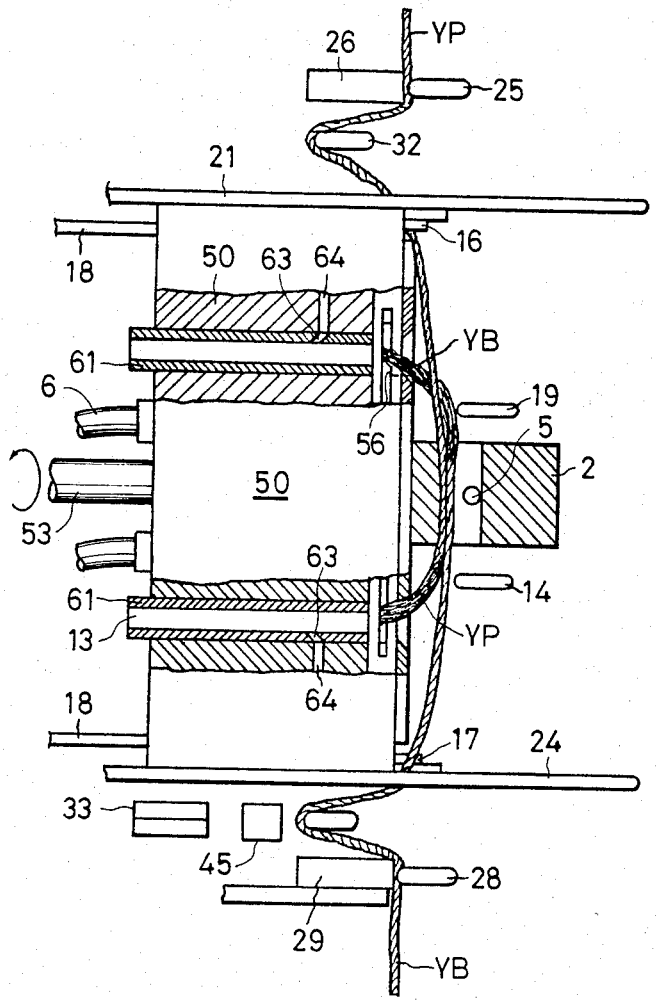

At the moment of or in synchronism with the interruption of the sucking action of the control nozzles 12 and 13 after the yarn ends of the yarns YB and YP have been untwisted in a state suitable for yarn splicing by the agency of the control nozzles 12 and 13, the yarn handling levers 32 advance again to draw out the yarn ends of the corresponding yarns YP and YB as shown in FIG. 9. When the length of the yarn end is longer than a predetermined length, the excessive part of the yarn end is left remaining in the control nozzle 12 or 13. Then, the cutter actuating lever 52 is turned within the groove 51 of the block 50 to actuate the movable blades 58 and 59 through pins 60 and 62 fitted in the bifurcate parts 54 and 55 of the cutter actuating lever 52, in order to cut off the free ends of the yarns YB and YP sucked into the control nozzles 12 and 13. The fibers thus cut off from the yarn ends are sucked into and removed through the flexible pipe 62. Cutting off the tips of the yarn ends removes unfavorable fibers, such as neps and slubs, adhering to the tips of the yarn ends.

Figure 10:
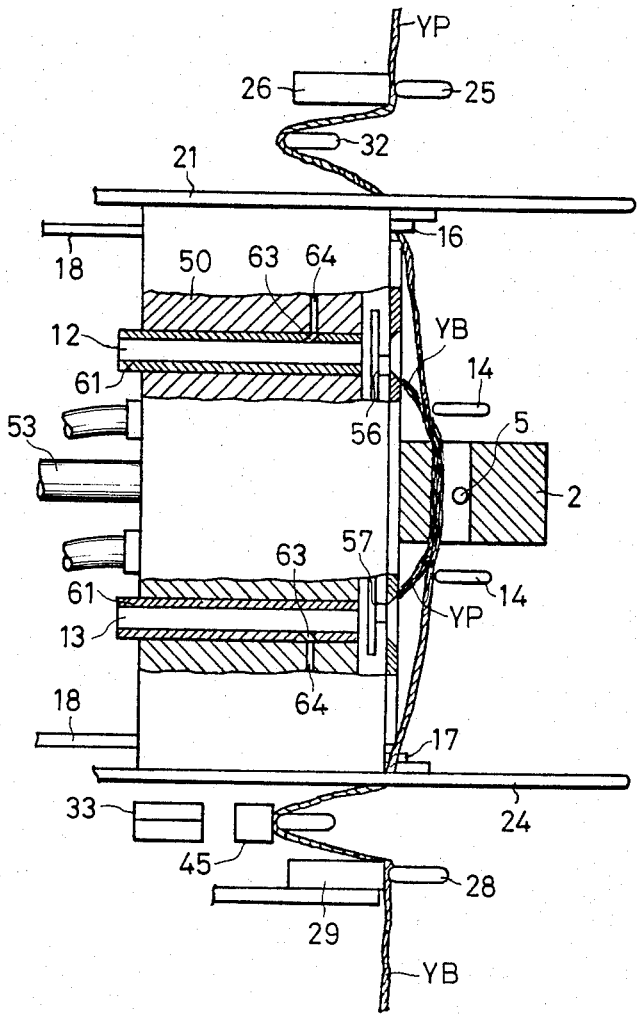

After the tips have been cut off, the yarns YB and YP are drawn out from the control nozzles 12 and 13, respectively, by the agency of the yarn handling levers 32 and are arranged within the yarn splicing hole 4. Since the stopper 45 is arranged to be adjustable in its position relative to the handling lever 32, the length of the yarn YB and YP drawn from the control nozzle 12 and 13, respectively, can be changed by adjusting the position of the stopper 45 so that the length of overlapped free yarn ends in the splicing hole 4 may be adjusted suitably (as shown in FIGS. 9 and 10).

Next, the pressurized fluid is jetted from the jet nozzle 5 against the overlapped part of the yarns. Since both untwisted yarn ends are overlapped each other, the pressurized fluid causes the fibers to entangle with each other to form an initial fiber entanglement. After the initial fiber entanglement has been formed, the yarns YB and YP are joined and turned to be a single yarn through the interior of the yarn splicing hole 4 while the fiber entanglement is promoted.

Upon the completion of the yarn splicing operation, the package side clamping device 27 and the bobbin side clamping device 30 release the yarns YP and YB, respectively, which have now been joined together in a single yarn, the yarn pressing levers 14 and the yarn handling levers 32 are retracted to release the yarn from the yarn splicing device 1, so that the yarn is allowed to return to the normal winding position and the winding operation is restarted.

As described hereinbefore, according to the present invention, the respective tips of the yarn ends untwisted within the control nozzles are cut off at a predetermined position after slightly drawing out the yarn ends from the corresponding control nozzles, therefore, neps and slubs which are liable to be formed in the yarn ends and irregularly projecting long fibers can be eliminated, the component fibers are caused to entangle completely with each other within the yarn splicing member and yarns can be spliced together to form a smooth spliced joint having no projecting fibers.

What is claimed is:

1. A pneumatic yarn splicing method of spun yarns including steps of pneumatically untwisting and loosening the respective free yarn ends to be spliced, overlapping the untwisted yarn ends one over another, and applying jetted fluid flow on the overlapped yarn ends to mix and entangle fibers of the yarn ends together for splicing, characterized in that each of said untwisted spun yarn ends is cut at a predetermined position thereof prior to overlapping the yarn ends to make the respective lengths of the untwisted yarn end portions uniform.

2. A pneumatic yarn splicing method for spun yarns as claimed in claim 1, wherein lengths of said untwisted portions of the yarn ends are adjusted by displacing a jetting hole of a control nozzle to vary the pressurized fluid supplying positions to the yarn ends relative to the type of yarns and yarn counts to be processed prior to the cutting step.

3. A pneumatic yarn splicing method for spun yarns as claimed in claim 1, wherein said cutting step comprises drawing the untwisted yarn ends out of control nozzles for untwisting yarn ends by the predetermined length so that an excessive part of the untwisted yarn end is left remaining in the control nozzle, cutting off the excessive tip of the free untwisted yarn end and sucking the tips of the yarn end cut off into the control nozzle to remove it therefrom.

4. A pneumatic yarn splicing method for spun yarns as claimed in claim 1, wherein said overlapping of the untwisted and cut yarn ends is performed by a movement of yarn handling levers which draw out the yarn ends from the control nozzle and the length of the overlapped untwisted yarn ends may be adjustable by adjusting the movement of the yarn handling levers, said movement being adjusted by displacing a stopper for the handling levers.

5. A pneumatic yarn splicing apparatus for spun yarns including a pneumatic yarn splicing member including a body having a splicing channel, control nozzles for untwisting and loosening the free yarn ends of a package side yarn and a bobbin side yarn, yarn guiding devices and yarn clamping devices, and yarn cutting devices for cutting the free yarn ends after the free yarn ends have been untwisted and unloosened by operation of the control nozzles.

6. A pneumatic yarn splicing apparatus as claimed in claim 5, wherein each control nozzle has a central longitudinal axis and wherein each of the cutting devices comprises a movable blade and a stationary blade, the movable blade crossing the axis of one of the control nozzles during operation of the cutting device.

7. A pneumatic yarn splicing apparatus as claimed in claim 6, wherein said cutting devices further include:

a cutter actuating lever, said lever having bifurcate parts formed in the opposite ends thereof and being pivoted on a shaft, and pins secured to the movable blades, the free end of the pins being inserted between the bifurcate parts.

8. An apparatus for splicing two yarns pneumatically comprising:

a splicing member body having a splicing channel formed therein;

means for cutting the ends of two yarns to be spliced prior to untwisting and unloosening the two yarn ends;

untwisting and unloosening means for untwisting and unloosening the ends of the two yarns to be spliced; and means for cutting the ends of the two yarns after operation of the untwisting means on the two yarn ends and prior to splicing the two yarns.

9. A method for pneumatically splicing the free ends of two yarns, comprising the steps of:

(1) bringing the free end of each yarn into a tube having two ends;

(2) applying pressurized fluid to the free end of each yarn while the free end is located in the tube thereby untwisting and unloosening the threads of the free end;

(3) removing a portion of the free end of each yarn end resulting from step (2); and (4) splicing the free ends of the yarns resulting from step (3).

10. A method according to claim 9 wherein the free end of each yarn is brought through one end of the tube by applying suction to the other end of the tube, and wherein the portion of the free end of each yarn resulting from step (2) is removed by cutting the portion from the free end.

* * * * *